US006602355B2

(12) United States Patent
Alstrup et al.

(10) Patent No.: US 6,602,355 B2
(45) Date of Patent: Aug. 5, 2003

(54) CORROSION RESISTANCE OF HIGH TEMPERATURE ALLOYS

(75) Inventors: Ib Alstrup, Holte (DK); Ib Chorkendorff, Birkerod (DK)

(73) Assignee: Haldor Topsoe A/S, Lyngby (DK)

( * ) Notice: Subject to any disclaimer, the term of this patent is extended or adjusted under 35 U.S.C. 154(b) by 26 days.

(21) Appl. No.: 09/982,769

(22) Filed: Oct. 22, 2001

(65) Prior Publication Data

US 2002/0079023 A1 Jun. 27, 2002

Related U.S. Application Data

(63) Continuation-in-part of application No. 09/505,436, filed on Feb. 16, 2000, now abandoned, which is a continuation-in-part of application No. 09/157,058, filed on Sep. 18, 1998, now abandoned.

(60) Provisional application No. 60/059,538, filed on Sep. 19, 1997.

(51) Int. Cl.[7] ..... C23C 26/00

(52) U.S. Cl. ..... 148/277; 148/537

(58) Field of Search ..... 428/685, 670, 428/673, 672, 648, 645, 644, 642; 148/537, 535, 530, 518, 240, 277, 285, 286

(56) References Cited

U.S. PATENT DOCUMENTS

| | | | |
|---|---|---|---|
| 3,634,048 A | 1/1972 | Koons et al. | |
| 3,979,273 A | 9/1976 | Panzera et al. | |
| 4,883,219 A | 11/1989 | Anderson et al. | |
| 5,397,652 A | 3/1995 | Carey et al. | |

FOREIGN PATENT DOCUMENTS

| | | | |
|---|---|---|---|
| DE | 2439739 | | 3/1976 |
| EP | 0903424 A1 | * | 3/1999 |
| JP | 56-9387 | | 1/1981 |
| JP | 58-96890 | | 6/1983 |
| JP | 60-118396 | | 6/1985 |
| JP | 61 119678 | | 6/1986 |
| JP | 61 166987 | | 7/1986 |
| JP | 11-172473 | * | 6/1999 |
| WO | WO 94/15896 | | 7/1994 |

OTHER PUBLICATIONS

Derwent Publication No. XP–002090077, "Heat Exchange With Improved Efficiency", Class J08, AN–81–39357D, May 1, 1981.

* cited by examiner

*Primary Examiner*—John J. Zimmerman
(74) *Attorney, Agent, or Firm*—Dickstein Shapiro Morin & Oshinsky, LLP

(57) ABSTRACT

A method for enhancing the protection of high temperature alloys containing iron, nickel and chromium against high temperature corrosion by carburization or metal dusting is achieved by depositing a thin layer of a metal selected from one or more of the noble metals, precious metals, metals from groups IVA, IVB, and group VA, VB of the Periodic Table and mixtures thereof with a thickness in the range of from 0.01 to 10 $\mu$m on the surface to be protected, and annealing the treated surface in an inert atmosphere at a predetermined temperature for a sufficient time to render the treated surface resistant to carburization or metal dusting.

5 Claims, No Drawings

CORROSION RESISTANCE OF HIGH TEMPERATURE ALLOYS

This application is a continuation-in-part of U.S. patent application Ser. No. 09/505,436, filed on Feb. 16, 2000, now abandoned, which is a continuation-in-part of U.S. patent application Ser. No. 09/157,058 filed Sep. 18, 1998, now abandoned, which claims the benefit of U.S. Provisional Application Serial No. 60/059,538, filed Sep. 19, 1997, the disclosures of which are hereby incorporated herein by reference.

BACKGROUND OF THE INVENTION

1. Field of the Invention

The present invention relates to a method for protecting high temperature alloys containing iron, nickel and chromium against high temperature corrosion caused by carburization or metal dusting.

2. Description of the Related Art

It is a major problem in many industrial processes that the high temperature alloys commonly used as construction materials are susceptible to corrosion by oxidation or carburization or metal dusting when exposed at high temperatures to gases with a high carbon potential. Carburization is observed in the petrochemical industry, where ethylene is produced in pyrolysis furnaces by thermal cracking of hydrocarbons in a steam-hydrocarbon mixture at temperatures up to 1100° C. In this cracking process, coke deposition occurs at the inner walls of the cracking tubes. In steam reformers, natural gas or other hydrocarbons are converted by catalytic reaction on nickel catalysts to CO and $H_2$. Carburization of the tube walls is observed after overheating or excessive carbon activities. In industrial furnaces for heat treatment or carburization of steels, carburization of the carrying grates and the furnace walls also occurs. Components of the $CO_2$-cooled nuclear reactor may be carburized by $CO_2$, and the heat exchangers of the helium-cooled reactor may be carburized by impurities such as CO and $CH_4$ in the helium. In coal gasification and in waste incineration plants, carburization is possible but the sulphidation and corrosion by chlorine will be more severe. Downstream of the steam reforming furnace, the heat recovering equipment is potentially vulnerable to a severe form of corrosion known as "metal dusting". It is a catastrophic carburization process to which alloys containing iron, nickel and cobalt is vulnerable, which results in the disintegration of the alloy into "dust" consisting of particles of carbon, carbides, metal and oxides. The result is wastage of the alloy surface. In contrast to the above-mentioned carburization, metal dusting occurs at temperatures as low as approximately 450° C. As a result of many studies, it has been concluded that virtually all available high temperature alloys are vulnerable to metal dusting. It has been shown that addition of $H_2S$ to the gas may provide some resistance towards carburization and metal dusting. However, because of the risk of undesirable effects, such as catalysts poisoning, this cannot be used in many cases. Efficient means, generally applicable, for protecting such alloys against high temperature corrosion have until now not been developed.

Usually, the protection of high temperature alloys against corrosion is dependent on the formation of an outer chromium-oxide layer. However, such an oxide layer may, under most practical conditions, not be protective for a very long time, because cracks can easily be formed in the oxide layer and spalling may occur due to loss of adherence to the underlying alloy. The same risks are present when a similar protection is attempted by coating the alloy surface with a protecting mixed oxide layer.

The method of the present invention does not suffer from such risks, because it does not depend on the formation of a surface oxide layer with thermal and mechanical properties vastly different from those of the alloy.

SUMMARY OF THE INVENTION

By the method of the present invention, a protective layer is formed on the surface of the high temperature alloy by annealing protection metals on the surface and thereby creating a thin surface alloy with the protective metal. Thus, the protective alloy has thermal and mechanical properties being similar to that of the high temperature alloy to be protected.

DETAILED DESCRIPTION OF THE PREFERRED EMBODIMENTS

In accordance with the present invention, there is provided a method for protecting parts and components of industrial plants such as containers, tubes, ferrules, etc. made of high temperature alloys containing iron, nickel and chromium and/or aluminum against corrosion by carburization or metal dusting. The method comprises: (a) cleaning of the alloy surface, (b) deposition of a noble or precious metal or of an element from group IVA (i.e., Sn and Pb), and IVB, or from group VA (i.e., Sb and Bi) and VB on the surface, and (c) heating of the surface in an inert gas or in a gas mixture consisting of an inert gas, hydrogen and water vapor in such proportions that the gas mixture is reducing towards iron and nickel, but oxidizing towards chromium and aluminum at the temperature of the heat treatment.

The heating takes place at a predetermined temperature in the range of 800–1000° C. for a period of time sufficient for the formation of a surface alloy consisting of the deposited element and one or more of the metallic elements of the substrate, high temperature alloy. It is conceivable that the formation of the stable surface alloy is decisive for the protection obtained.

Deposition of the above metals may be carried out by conventional methods including physical or chemical vapour deposition or dipping, spraying or plating. Preferably, the metal is deposited to a thickness in the range of 0.01 to 10 $\mu$m.

Formed in this manner, the surface alloy is preferably a uniform distribution of the noble or precious metal or group IVA, IVB, VA or VB metal on and in the surface to be protected. For example, in cases where a gas mixture containing hydrogen and water vapor is used during the heating treatment, a thin chromium oxide and/or aluminum oxide layer is formed on top of the surface alloy. This thin oxide layer contributes to the protection of the alloy.

EXAMPLES

The following examples serve to describe the manner of making and using the above-mentioned invention in detail.

A number of metal dusting corrosion tests were carried out using as test samples cylindrical disks with a diameter of approximately 18 mm and a thickness of 6 mm made of Alloy 800 H with the following composition in wt %:

0.05–0.1 C, max. 1.0 Si, max. 1.5 Mn, max. 0.015 S, 30.0–35.0 Ni, 20.0 Cr, 45 Fe, 0.15–0.6 Ti, 0.15–0.6 Al, max. 0.75 Cu.

Example 1

Test samples have been tested for metal dusting corrosion at the following conditions:

| | |
|---|---|
| Gas pressure | 34 bar |
| Gas composition | 49.3% $H_2$, 15.6% CO, 5.6% $CO_2$, 29.5% $H_2O$ |
| Gas velocity | max. 10 m/s |
| Sample temperature | 650° C. |
| Duration | 200 h |

Tests have been carried out after no surface treatment and after a number of different conventional pretreatments comprising polishing and cleaning of the surface, mechanical treatment, and oxidation of the surface. The mechanical treatments used are sandblasting and shot peening. In all these cases severe metal dusting attacks, i.e., carbon formation, pitting and loss of material were observed after a test. However, when the test sample was pretreated in accordance with the present invention, no sign of corrosion could be seen on the pretreated surface after the above-mentioned metal dusting corrosion test.

The following pretreatment was used: The surface was polished and cleaned. An approximately 1 μm thick gold layer was deposited by physical vapour deposition on the surface to be protected. Finally, the sample was kept at 900° C. for 30 min. in a flow of helium.

Example 2

An alloy 800 H test sample with the above-mentioned composition has been tested at the following conditions:

| | |
|---|---|
| Gas pressure | 34 bar |
| Gas composition | 39.4% $H_2$, 37.2% CO, 1.7% $CO_2$, 21.7% $H_2O$ |
| Gas velocity | max. 10 m/s |
| Sample temperature | 653° C. |
| Duration | 100 h |

The following pretreatment was used before the test:

The sample surface was polished and cleaned. An approximately 3 μm thick tin layer was deposited electrochemically on the surface. The sample was kept at 800° for 30 min. in a flow of helium.

No sign of corrosion could be seen on the pretreated surface after the metal dusting corrosion test.

An additional number of metal dusting corrosion tests were carried out using as test samples cylindrical disks with a diameter of approximately 18 mm and a thickness of 6 mm made of Hynes 230 alloy.

The alloy compositions in wt % are:

Haynes 230

01. C, 0.4 Si, 57.0 Ni, 22.0 Cr, 3 Fe, 5 Co, 14 W, 2 Mo, 0.3 Al

Example 3

| | |
|---|---|
| Gas pressure | 34 bar |
| Gas composition: | 39.2% $H_2$, 37.6% CO, 1.6% $CO_2$, 21.6% $H_2O$ |
| Gas velocity: | max. 10 m/s |
| Duration: | 53–90 h |

In all tests, a large number of corrosion pits were seen on the surface of the sample after the test.

Example 4

A test sample made of Haynes 230 alloy was pretreated by polishing, cleaning and by depositing a ca. 3 μm layer of gold electrochemically on the surface. The sample was subsequently annealed at 1000° C. for 30 min. in a flow of helium with a small concentration of water vapor entering the reactor from a bubble flask at the outlet of the reactor. Studies of the composition of the sample as a function of the depth below the surface by means of depth profiling using argon ion bombardment and Auger electron spectroscopy show that this annealing treatment result in the formation of a gold-chromium surface alloy and on top of that a thin layer of chromium oxide.

A test sample pretreated in the same way was tested for 100 h at the conditions described in Example 3. No sign of corrosion was seen on the sample after the test.

Example 5

A test sample made of Haynes 230 alloy was pretreated by polishing, cleaning and by depositing a ca. 3 μm layer of tin electrochemically on the surface. The sample was subsequently annealed at 800° C. for 30 min. in a gas mixture of argon, hydrogen, and water vapor in the ratios 90.0:7.7:2.3. Studies of the composition of the sample as a function of the depth below the surface by means of depth profiling using argon ion bombardment and Auger electron spectroscopy show that this annealing treatment result in the formation of a tin-nickel surface alloy and on top of that, a thin layer of chromium oxide.

A test sample pretreated in the same way was treated for 100 h at the conditions described in Example 3. No sign of corrosion was seen on the sample after the test.

Although the present invention has been described in relation to particular embodiments thereof, may other variations and modifications and other uses will become apparent to those skilled in the art. Therefore, the present invention is to be limited not by the specific disclosure herein, but only by the appended claims.

What is claimed is:

1. A method for the protection of high temperature alloys containing iron, nickel, chromium and/or aluminum against high temperature corrosion by carburization or metal dusting comprising the steps of:

(a) depositing a noble metal or a metal from group IVA or from group VA on a surface to be protected; and (b) heating the surface in a gas mixture consisting of an inert gas, hydrogen and water vapor in such proportions that the gas mixture is reducing towards iron and nickel, and oxidizing towards chromium and/or aluminum at a temperature at which the surface is heated to thereby form on the surface of the high temperature alloy to be protected an intermediate protection alloy with the deposited metal and the high temperature alloy and a top layer of chromium oxide and/or aluminum oxide.

2. The method of claim 1, wherein the metal is a group IVA metal selected from Sn and Pb.

3. The method of claim 1, wherein the metal is a group VA metal selected from Sb and Bi.

4. The method of claim 1, wherein the metal is deposited to a thickness in the range of 0.01 to 10 μm on the surface to be protected.

5. The method of claim 1, wherein the heating is carried out at a temperature of at least 800° C.

* * * * *